United States Patent [19]

Gribble et al.

[11] Patent Number: 4,862,950

[45] Date of Patent: Sep. 5, 1989

[54] APPARATUS AND METHOD FOR CONTROLLING THE ENVIRONMENT IN A SUBSTANTIALLY ENCLOSED AND PRESSURIZED WORK AREA SUCH AS A TEXTILE MANUFACTURING PLANT

[76] Inventors: Robert L. Gribble, 13823 Queens Harbor Rd., Apt 223-H, Charlotte, N.C. 28217; Robert R. Sinyard, 3621 Country Club Dr., Gastonia, N.C. 28054

[21] Appl. No.: 274,874

[22] Filed: Nov. 22, 1988

[51] Int. Cl.[4] ..... B01F 3/02

[52] U.S. Cl. ..... 165/20; 73/336.5; 236/44 A

[58] Field of Search ..... 165/20, 21; 236/44 A, 236/44 B; 73/336.5; 62/176.6

[56] References Cited

U.S. PATENT DOCUMENTS

| | | | |
|---|---|---|---|
| 2,126,266 | 8/1938 | Laird | 62/176 |
| 2,953,355 | 9/1960 | Hungate | 165/20 |
| 3,277,954 | 10/1966 | Meckler | 165/20 |
| 3,599,862 | 8/1971 | Hogan et al. | 236/44 C |
| 4,089,666 | 5/1978 | Knight | 62/91 |
| 4,105,063 | 8/1978 | Bergt | 165/21 |
| 4,290,480 | 9/1981 | Sulkowski | 165/21 |
| 4,312,189 | 1/1982 | Cotton, Jr. | 62/176 C |
| 4,356,834 | 11/1982 | LeMay | 137/89 |
| 4,359,286 | 11/1982 | Sutoh et al. | 236/44 A |
| 4,399,864 | 8/1983 | Lamar | 165/20 |
| 4,430,828 | 2/1984 | Oglevee et al. | 165/21 |
| 4,482,007 | 11/1984 | Yoshimi et al. | 165/21 |
| 4,494,596 | 1/1985 | Bradshaw | 165/20 |
| 4,552,303 | 11/1985 | Fisher et al. | 236/44 C |
| 4,662,560 | 5/1987 | Norris et al. | 236/44 B |

*Primary Examiner*—William E. Wayner

*Attorney, Agent, or Firm*—Bell, Seltzer, Park & Gibson

[57] ABSTRACT

A system and method for controlling the enivronment toward obtaining a prespecified absolute humidity within a substantially enclosed and pressurized work area such as a textile manufacturing plant is disclosed. A plurality of condition sensing signal generating sensors are positioned within the work area. A first signal generator sensor is responsive to sensed relative humidity, a second signal generator sensor is responsive to sensed dry bulb temperature, and a third signal generator sensor is responsive to sensed barometric pressure. An air washer operatively communicates with the work area for conditioning the air enclosed within the work area. A microprocessor operatively connects the air washer and the condition sensing sensors for receiving and correlating within the microprocessor the received sensed values so as to repeatedly adjust the operation of the air washer and condition the air within the work area toward obtaining the predetermined absolute humidity.

52 Claims, 4 Drawing Sheets

PERCENTAGE CHANGE OF MOISTURE IN SATURATED AIR FOR A ONE INCH RISE IN BAROMETRIC PRESSURE FROM STANDARD BAROMETRIC PRESSURE

| WET BULB ↓ / DRY BULB → | 70 | 72 | 74 | 76 | 78 | 80 | 82 | 84 | 86 | 88 | 90 |
|---|---|---|---|---|---|---|---|---|---|---|---|
| 60 | 4.16 | 4.20 | 4.50 | 5.10 | 5.70 | 5.95 | 6.10 | 6.50 | 6.95 | 7.70 | 8.33 |
| 62 | 3.88 | 4.35 | 4.25 | 4.48 | 4.85 | 5.35 | 5.40 | 5.80 | 6.10 | 6.45 | 7.11 |
| 64 | 3.63 | 3.85 | 4.08 | 4.24 | 4.40 | 4.69 | 4.83 | 5.10 | 5.37 | 5.75 | 6.04 |
| 66 | 3.51 | 3.61 | 3.83 | 4.00 | 4.20 | 4.35 | 4.62 | 4.78 | 5.00 | 5.32 | 5.70 |
| 68 | 3.40 | 3.50 | 3.60 | 3.82 | 3.98 | 4.10 | 4.25 | 4.55 | 4.72 | 4.95 | 5.23 |
| 70 | N/A | 3.39 | 3.51 | 3.60 | 3.81 | 3.94 | 3.99 | 4.16 | 4.44 | 4.60 | 4.90 |
| 72 | N/A | N/A | 3.38 | 3.52 | 3.60 | 3.81 | 3.88 | 3.98 | 3.98 | 4.33 | 4.43 |
| 74 | N/A | N/A | N/A | 3.36 | 3.50 | 3.60 | 3.80 | 3.80 | 3.94 | 3.97 | 4.22 |
| 76 | N/A | N/A | N/A | N/A | 3.38 | 3.51 | 3.60 | 3.79 | 3.78 | 3.89 | 3.95 |
| 78 | N/A | N/A | N/A | N/A | N/A | 3.39 | 3.50 | 3.59 | 3.75 | 3.75 | 3.88 |
| 80 | N/A | N/A | N/A | N/A | N/A | 3.33 | 3.39 | 3.49 | 3.58 | 3.70 | 3.72 |

APPARATUS AND METHOD FOR CONTROLLING THE ENVIRONMENT IN A SUBSTANTIALLY ENCLOSED AND PRESSURIZED WORK AREA SUCH AS A TEXTILE MANUFACTURING PLANT

FIELD OF THE INVENTION

This invention relates to an apparatus and method for controlling the environment of the air enclosed within a work space and more particularly to an apparatus and method for controlling absolute humidity of the air enclosed within a substantially enclosed and pressurized work space such as a textile manufacturing plant containing a plurality of textile processing machines, such as a spinning frame, wherein optimum textile processing occurs within a relatively narrow range of temperature and humidity.

BACKGROUND OF THE INVENTION

It is common in a textile manufacturing plant to condition the air enclosed within the plant with an air washer. Humidity control is essential to reduce the number of parted or broken ends encountered with various textile manufacturing processes. Many textile plants control humidity by varying the operation of the air washer so as to control the dew point of the air being directed to the work area. Although dew point control varies from one air washer to another it is possible to control the dew point of the air directed from the air washer to the work area by varying such factors as chilled water or steam supplied to the air washer. Most plants control dew point by varying the amounts of return, bypass and ambient or outside air passing through the air washer. For example, if an amount of hotter return air flowing through the air washer is decreased, but an amount of cooler outside air flowing through the air washer is increased, the effective reduction in temperature lowers the dew point of the air and adjusts overall humidity of the air flowing from the air washer into the textile manufacturing area. Most textile plants monitor the temperature and humidity within the plant, and correlate the sensed values of temperature and humidity to standard psychrometric charts to determine what air washer operation adjustments are necessary to condition the air towards an optimum humidity range and reduce the number of parted or broken ends which occur during processing.

Heretofore, most prior art textile air washer systems separately monitor temperature and relative humidity to control the air washer. However, these systems have sustained unexplained periods of time when the humidity of the air appears to be maintained but it is noticed that the number of parted or broken ends increases for no apparent reason. This is especially noticed when an amount of outside ambient air is drawn through the air washer and into the work area. Depending on the instrumentation used within a particular mill, no measured change of environmental condition occurs.

We have determined that any slight change in the barometric pressure within the textile manufacturing environment has a marked effect on the number of parted or broken ends in all types of textile manufacturing processes. The changes in barometric pressure affect the total amount of moisture contained within the air which in turn adversely affects production levels. Not only do the outside atmospheric changes affect the pressure within the mill, but in addition, pressure fluctuations rapidly occur within the textile manufacturing plant when the amounts of ambient, outside air flowing through the air washer into the mill fluctuates. In some cases the ambient outside air not only must force out the air enclosed within the work area but it also changes the pressure within the mill. Some of the air enclosed within the work area will recycle as return or bypass air, but much of that air must be expelled. Since each plant has a different expelling system as well as a different air washer system, the variations in pressure within the mill created by the drawn in ambient, outside air will vary from plant to plant. Thus, each plant will differ as to the effect both drawn in ambient, outside air and normal atmospheric pressure changes have on the mill's operation.

It is therefore an object of this invention to provide a system for conditioning the air enclosed within a textile manufacturing plant towards obtaining a prespecified absolute humidity.

It is a further object of this invention to provide a system for controlling the environment within a substantially enclosed and pressurized work area such as textile manufacturing plant which accounts for changes in pressure within the work area.

It is a further object of this invention to provide a system for controlling the environment toward obtaining a prespecified absolute humidity within a substantially enclosed and pressurized work area such as a textile manufacturing plant wherein sensed valves of relative humidity, dry bulb temperature and barometric pressure received from the work area are correlated within a microprocessor to effect adjustments of an air washer system operatively communicating with the work area.

It is a further object of this invention to provide a system for controlling the environment toward obtaining a prespecified absolute humidity within a substantially enclosed and pressurized work area in a textile manufacturing plant containing a plurality of textile processing apparatus such as a spinning frame of either the ring spinning or open-end spinning type wherein yarn is being formed from textile fibrous material so as to provide for enhanced operation of and production from the textile processing apparatus and reduce the number of parted or broken ends.

It is a further object of this invention to provide a system for controlling the environment toward obtaining a prespecified absolute humidity within a substantially enclosed and pressurized work area in a textile manufacturing plant wherein the work area includes a plurality of work zones separated from each other by walls or other means internal to the work area and wherein at least one of the work zones contains a plurality of textile processing apparatus such as a spinning frame wherein yarn is being formed from textile fibrous material so as to provide for enhanced operation of and production from the textile processing apparatus and reduce the number of parted or broken ends.

SUMMARY OF THE INVENTION

A system and method for controlling the environment toward obtaining a prespecified absolute humidity within a substantially enclosed and pressurized work area such as a textile manufacturing plant containing a plurality of textile processing apparatus such as a spinning frame of either the ring spinning or open-end spinning type is disclosed wherein a plurality of condition sensing signal generating means are positioned within the work area with the signal generating means being responsive to sensed environmental conditions. The signal generating means includes a first signal generating means responsive to sensed relative humidity, a second signal generating means responsive to sensed dry bulb temperature and a third signal generating means responsive to sensed barometric pressure. An air washer operatively communicates with the work area for conditioning the air enclosed within the work area. A microprocessor operatively connects the air washer and the condition sensing signal generating means for receiving and correlating within the microprocessor the sensed values and then repeatedly adjusting the operation of the air washer so as to condition the air within the work area toward obtaining the prespecified absolute humidity.

In the preferred embodiment the microprocessor comprises a signal generating means for transmitting signals to the air washer for effecting repeated adjustments to the air washer. The air washer includes a damper means for receiving and varying the amount of return air flowing from the work area through the air washer and back into the work area, ambient air drawn in from outside the work area through the air washer and into the work area, and bypass air flowing from the work area, into an area outside the work area and back into the work area. Means are also included to control the temperature of water supplied to the air washer and the operation of the air washer in response to air washer operation adjustments determined by the microprocessor, such as the amount of air passing through the air washer, or the atomization of water supplied to the air washer.

BRIEF DESCRIPTION OF THE DRAWINGS

Some of the objects and advantages of this invention having been set forth above, other objects and advantages will appear as the description proceeds, when taken in conjunction with the accompanying drawings, in which.

DETAILED DESCRIPTION OF THE PREFERRED EMBODIMENT

Figure 1:
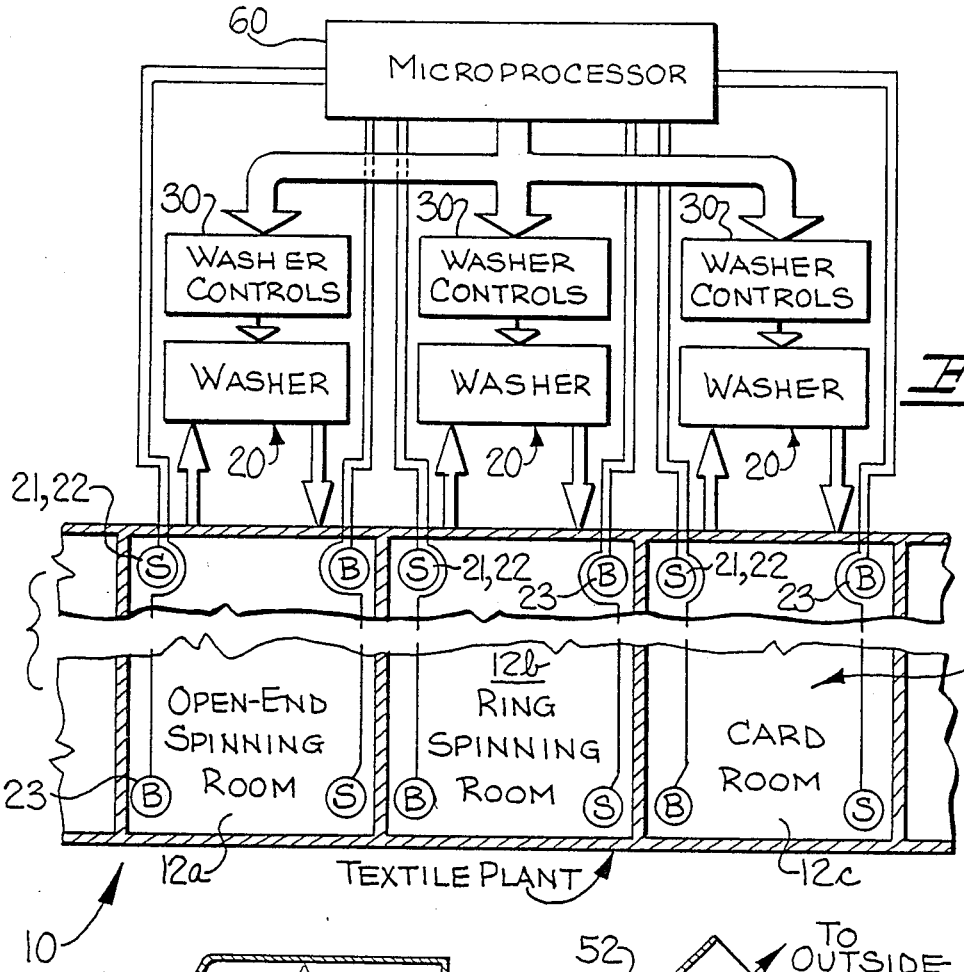
FIG. 1 is a highly diagrammatic view of a textile manufacturing plant having an air washer system controlled by the present invention.
Figure 2:
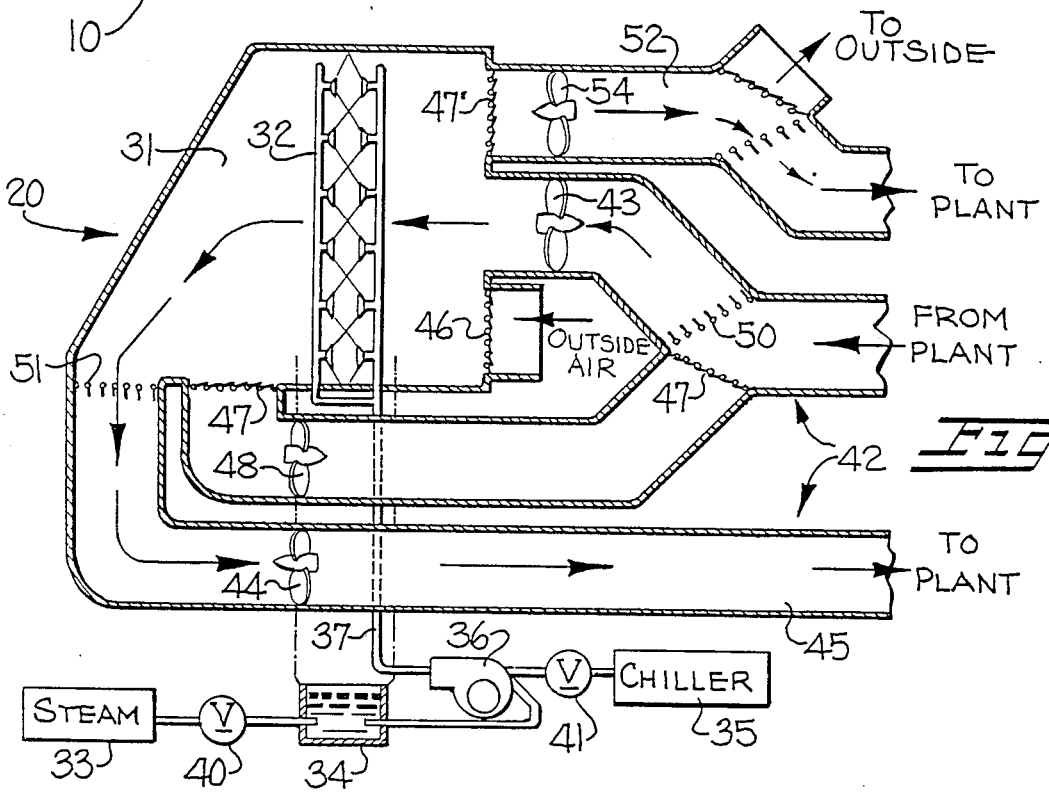
FIG. 2 is a diagrammatic representation of an air washer showing the various washer controls controlled by the present invention.

Referring more particularly to the drawings, and FIGS. 1 and 2, there is illustrated a system for controlling the environment within a textile manufacturing plant 10 toward obtaining a prespecified absolute humidity. The system is applied to an existing textile manufacturing plant 10 having three air washers 20 which condition the air within the manufacturing plant 10. Although it is understood that textile air washers vary in design and sophistication, the illustrated embodiment is typical of many air washers currently used in textile manufacturing plants where sensed values of temperature and relative humidity are correlated to standard psychrometric charts based on 29.93 inches of mercury (14.7 psia) to determine what air washer operation adjustments are necessary to condition the air within the plant toward obtaining desired relative humidity and dry bulb temperature levels. As is also conventional, some textile air washers utilize dewpoint sensors at the discharge end of the air washer. The sensed dewpoint is compared with a desired dewpoint and air washer operation adjustments made accordingly.

The present invention obviates the need for any dewpoint sensing since the values of dry bulb temperature, relative humidity and barometric pressure are sensed within the manufacturing work area and the sensed values are correlated within a microprocessor indicated generally at 60. Based upon the correlated sensed values, air washer operation adjustments are effected so as to condition the air within the manufacturing plant toward obtaining a prespecified absolute humidity.

The present invention is noticeably advantageous over prior art systems since it takes into consideration pressure changes which often occur in a textile manufacturing plant. Most conventional textile manufacturing plants do not account for any pressure changes occurring within a work area. However, pressure considerations are necessary. For example, an open-end spinning room operates efficiently at 68° F. dry bulb and 58 percent relative humidity at a standard pressure of 29.93 inches of mercury. The room experiences an approximate three degree increase in dry bulb temperature due to an influx of outside, ambient air flowing into a work area. The effective reduction in relative humidity based on standard psychrometric charts of 29.93 inches of mercury is approximately 6 to 8 percent. However, the outside ambient air flowing into the work area often will increase the barometric pressure within the plant which in turn drives moisture from the air. To maintain a prespecified amount of grains of moisture per pound of air, i.e. absolute humidity, adjustments to an air washer must be made as if there is a 36 to 40% relative humidity condition at 71° dry bulb and 29.93 inches of mercury. The operation of the air washer is adjusted so as to increase the absolute humidity of the air.

The present invention is adaptable for use with air washers currently used in textile manufacturing plants. Any air washer dewpoint sensors can be bypassed while existing relative humidity and dry bulb temperature sensors positioned in a work area either can be utilized or bypassed so that more modern and accurate dry bulb and relative humidity sensors can be placed therein.

Referring more particularly to FIG. 1, the system of the present invention is shown where a representative textile manufacturing plant 10 includes a substantially enclosed and pressured work area 11 divided into three work zones 12*a*, 12*b*, 12*c* separated from each other by walls 13. The work area 11 is pressurized slightly owing to the constant pressure created within the work area 11 by the air movement through the air washers 20 into the work area 11.

In the illustrated embodiment, each work zone 12*a*, 12*b*, 12*c* is a separate processing area and includes apparatus (not shown) for carrying out a textile processing operation such as carding or spinning of either the ring spinning or open-end spinning type. As shown in FIG. 1, flow and processing of textile material is from right to left. Staple fibers are carded in a card room 12*c*, and then either spun in ring spinning or open-end spinning apparatus which is positioned in adjacent work zones 12*a* and 12*b*.

The system of the present invention controls the environment within the work area 11 towards obtaining a prespecified absolute humidity. The increased humidity control allows an enhanced operation of and production from any textile apparatus since the percentage of parted or broken ends is decreased. Textile fibers which do not contain enough moisture is a major factor in creating static charges during a spinning operation. Static charges dramatically increase the number of parted or broken ends during processing. Moisture control in the work area 11 aids in establishing moisture control over the textile fiber. In this regard, moisture control especially is critical in the card room 12*c* where the fibers are more loose then the fibers processed in either the ring spinning or open-end spinning room 12*a* and 12*b*. The tighter fibers processed in an open-end or ring spinning operation do not readily absorb moisture from the air enclosed within the work zone 12*a*. Thus, moisture control is critical in the card room 12*c* to assure that the textile fibers contain sufficient moisture to prevent parted or broken ends in a subsequent open-end or ring spinning operation.

Each work zone 12*a*, 12*b* and 12*c* also includes an air washer 20 operatively communicating therewith. The system of the present invention controls the operation of each air washer 20 to condition the air enclosed within each work zone 12*a*, 12*b* and 12*c* towards obtaining a prespecified absolute humidity. The system includes respective first, second and third signal generating sensors 21, 22 and 23 positioned within each work zone 12*a*, 12*b* and 12*c* which are responsive to respective relative humidity, dry bulb temperature and barometric pressure.

In the illustrated embodiment, the relative humidity and temperature sensors 21, 22 are shown positioned together at similar positions since both sensors 21, 22 are contained within a single support housing (not shown). Although any number of sensors may be used in each work zone 12*a*, 12*b*, 12*c*, only a limited number of sensors 21, 22, 23 which are sufficiently spaced from each other are needed to obtain a true reading of the environmental conditions within each work zone 12*a*, 12*b*, 12*c*. In the illustrated embodiment, only two of each of the sensors 21, 22, 23 are shown positioned diagonally across from one another to assure that variations in relative humidity, dry bulb temperature and barometric pressure can be measured.

The generated signals for the sensed values of relative humidity, dry bulb temperature and barometric pressure are received into the microprocessor 50 where they are correlated so as to determine what air washer operation adjustments are necessary to condition the air enclosed within each work zone 12*a*, 12*b*, 12*c* towards obtaining a prespecified absolute humidity. After correlating, the microprocessor effects repeated adjustments to the air washer controls 30 to adjust the operation of the air washers 20 and condition the air passing therethrough.

The air washer controls 30 are conventional and include those controls which modify the various air washer operating functions. These operating functions include the steam and chilled water valves, the air washer spray pump, the fans as well as the various dampers. The microprocessor 60 takes direct control of these functions and adjusts their operation to condition the air passing through the air washer 20 so as to obtain a prespecified absolute humidity within the work area 11.

Referring now more particularly to the air washer 20 illustrated in FIG. 2, there is shown a type of air washer as would conventionally be found in a textile manufacturing plant 10 for conditioning the air therein.

As is conventional, the air washer 20 includes a spray chamber housing 31 having water spray apparatus 32 positioned therein. The water spray apparatus 32 is supplied with either heated or chilled water. A steam generator 33 and condensor 34 provide a source of heated water and a chiller 35 provides chilled water. A water pump 36 and water supply lines 37 having respective steam and chilled water valves 40, 41, vary the amounts of either heated or chilled water which can be delivered to the water spray apparatus 32 so as to regulate the overall temperature of the water curtain within the spray chamber housing 31. In addition, by varying the volumetric flow rate of water through the pump 36, the water atomization within the spray chamber housing 31 also can be controlled. As is well known, both the temperature and volumetric flow of the air washer water affect the humidification of air passing through the air washer 20.

A duct system 42 interconnects the air washer 20 with the work area 11 of the textile manufacturing plant 10. Included within the duct system 42 are various fans and dampers. Each fan and damper includes a motor (not shown) integral therewith for controlling air flow through the duct system 42. Each fan and damper motor is directly controlled by the microprocessor 60 so that not only can the total air flow generated by the fans be regulated, but the amounts of return, bypass and ambient, outside air also can be regulated by opening and closing the dampers.

It is understood that the illustrated embodiment shown in FIG. 2 is a diagrammatic representation of the various dampers and fans used in an air washer system. Air washer designs vary in every textile manufacturing plant and the illustrated embodiment is shown for teaching purposes only.

In operation, return air is drawn by the inflow and outflow return fans 43, 44 into the return air duct line 45, through the spray chamber 31 and back into the work area 11. The return air is conditioned as it passes through the water curtain of the air washer 20. Normally, if all return air is recycled, the outside damper 46 and all bypass dampers 47 are closed, and bypass fans 48 are inoperative while the return air and outflow dampers 50, 51 are open. Also, as is conventional, the proportions of bypass and outside air may be varied. For example, an amount of cooler, outside air also may be drawn through the spray chamber housing 31 while a proportional amount of hotter return air flowing through the spray chamber housing 31 may be decreased. This condition would lower the dewpoint of the air returning into the work area 11 and effectively condense some of the moisture from the air. To accomplish such a condition, the outside air damper 46 is opened partially while the return damper 50 is closed a proportional amount. Likewise, the total volume of air coming from the work area 11 can be bypassed around the air washer 11 by closing the outside and return dampers 46, 50 while opening bypass and outflow dampers 47, 51. It is advantageous to bypass air when the absolute humidity within the work area 11 has reached a prespecified value. To move the withdrawn air through the water curtain may adversely affect the humidity within the work area 11. However, only in rare occasions will air be bypassed around the water curtain since the water curtain functions secondarily to cleanse the air and remove lint and other textile particles suspended in the air.

Outside air is drawn through the air washer 20 by opening the outside air damper 46. If the air washer 20 is to operate solely on outside air, air contained within the work area 11 is expelled through an exhaust duct 52 and exhaust damper 53. In the illustrated embodiment, bypass air also can be drawn through the bypass damper 47' and the exhaust duct 52 by placement of a suitable exhaust fan 54 therein.

One particular advantage of the present invention is the microprocessor's continual and repeated adjustments to the operation of the air washer 20. In many textile air washer systems, the air washer controls 30 are adjusted manually by a human operator whenever the relative humidity of the air enclosed within the manufacturing plant 10 changes or an operator has noticed that the percentage of parted or broken ends has increased. This method is predominantly a hit or miss approach. If any noticeable improvement in mill operation is made, the air washer controls 30 are then left alone. In the present invention, the use of a microprocessor 60 to correlate not only the sensed values of relative humidity and dry bulb temperature but also the barometric pressure, permits much greater humidity control within the work area 11 without a hit or miss approach. The present invention also allows a greater utilization of some of the textile manufacturing plant's resources to condition the air towards obtaining a prespecified absolute humidity. For example, the hot exhaust air from open-end spinning apparatus now may be utilized to increase the efficiency of the air washer 20.

Figure 3:
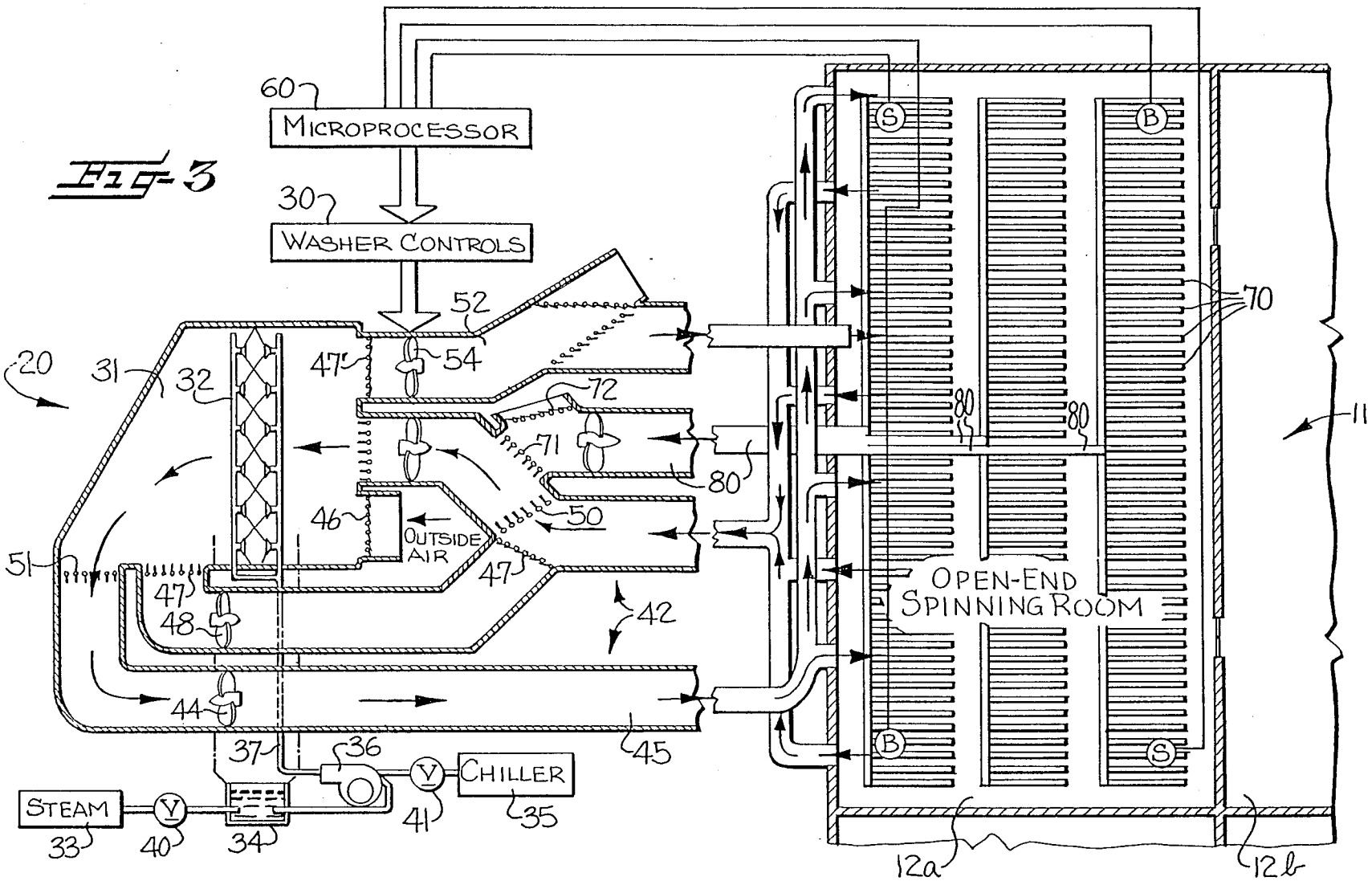
FIG. 3 is a diagrammatic representation of an open-end spinning room and a modified air washer used to condition the air within the open-end spinning room.

Referring now more particularly to FIG. 3, there is shown the basic air washer 20 of FIG. 2 which is now modified for use with the open-end spinning room 12*a* of the textile manufacturing plant 10. Open-end spinning is distinguished from ring spinning since much greater exhaust heat is generated during the open-end spinning operation. Heretofore, this exhaust heat generated from an open-end spinning apparatus often was exhausted either into the work area 11 as sensible heat, thus increasing any air conditioning requirement, or expelled outside the plant. As a result, a potential energy source was wasted, or, too much heat was generated in an open-end spinning room 12*a*.

Figure 4:
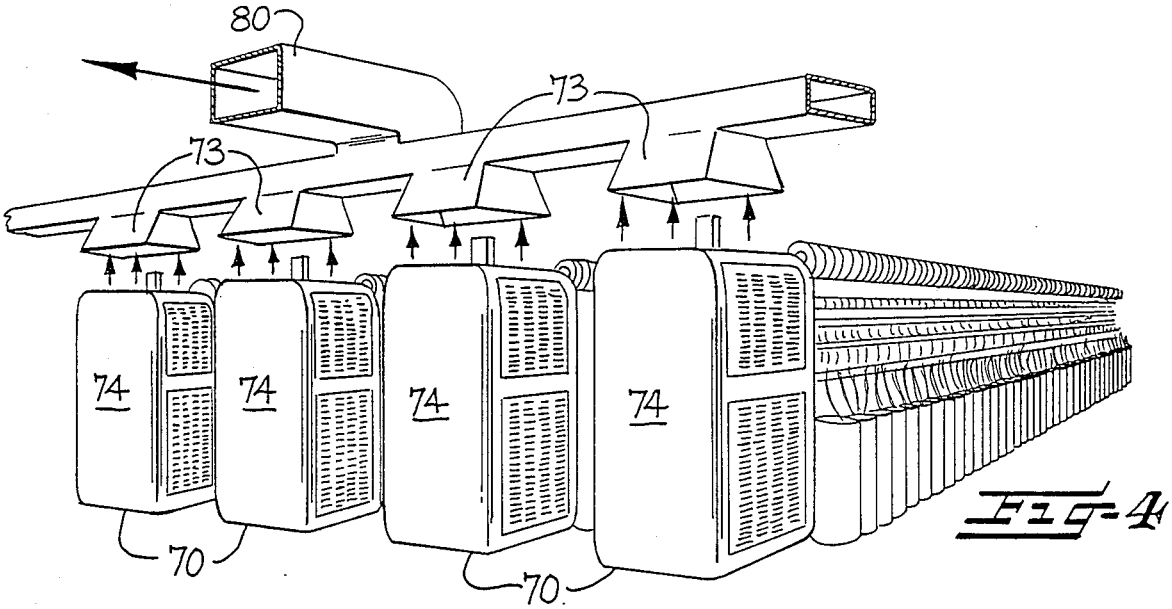
FIG. 4 is a perspective view of the exhaust system used to withdraw hot exhaust air from off a spinning frame of the open-end spinning type.
Figure 5:
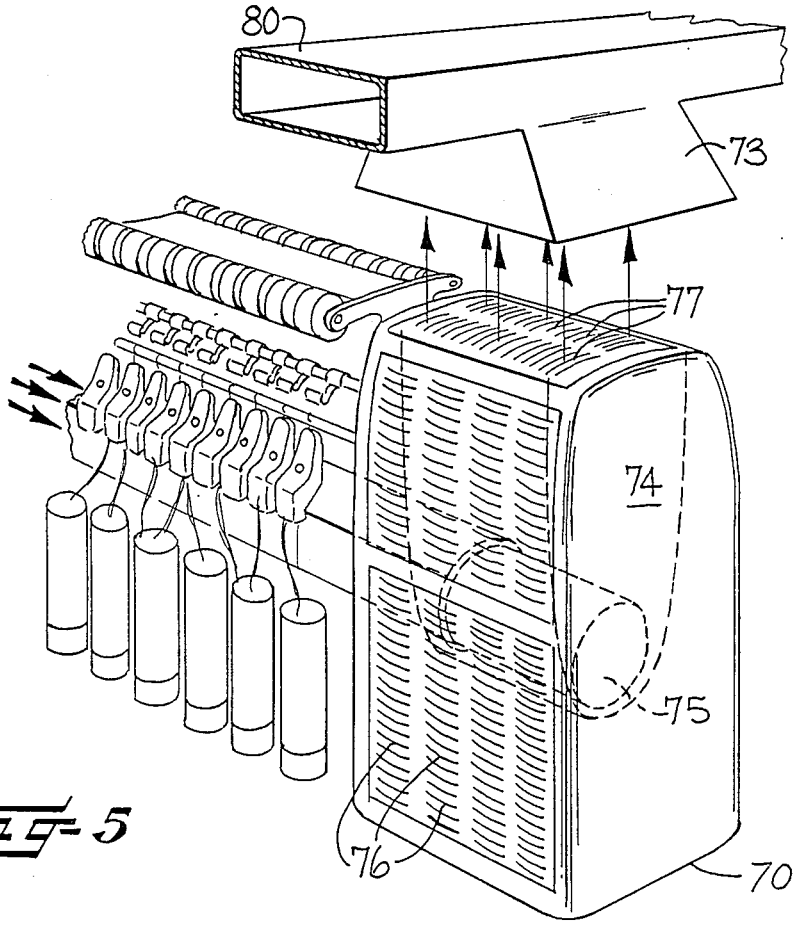
FIG. 5 is a perspective view of an open-end spinning apparatus in partial schematic showing an exhaust hood used in conjunction therewith for withdrawing the hot exhaust air therefrom.

As shown in FIGS. 4 and 5, the hot exhaust gas produced by the open-end spinning apparatus 70 is collected and transferred to the air washer 20 where it is passed either through an open-end return damper 71 and into the spray chamber 31 or through an outside open-end damper 72 to an area outside the manufacturing plant (FIG. 3). To collect the hot exhaust air from off an open-end spinning apparatus 70, an exhaust collection hood 73 is positioned over the motor housing 74 of each open-end spinning apparatus 70. The high speed spinning motor 75 positioned within the motor housing 74 turns the main feed shaft (not shown) which runs transversely along the interior length of the apparatus at speeds of up to 30,000 r.p.m. During spinning, cool room air is drawn through the side inlet vents 76 into the motor housing 74. The drawn-in room air cools the spinning motor 75 and is then exhausted at temperatures ranging from 120 to 160 degrees F. through the exhaust vents 77 located on the top of the motor housing 74.

The exhaust collection hood 73 is approximately two foot square and is positioned approximately two feet over the exhaust vents 77. Each exhaust collection hood 73 interconnects a main open-end exhaust duct system 80 which removes the hot exhaust air to the air washer 20 where varying amounts of the hot exhaust air may be mixed with return and outside air passing through the spray chamber housing 31. Since the microprocessor 60 continually correlates the data received from the relative humidity, dry bulb temperature, and barometric pressure sensors 21, 22, 23, finite adjustments can be made to the open-end return and outside dampers 71, 72 to account for changed environmental conditions within the work area 11.

For example, in one application of the invention, the textile manufacturing plant 10 is operated so that all the open-end exhaust air is exhausted outside the plant 10 while return air is recycled completely through the air washer 20. For a period of time, a stable balance of a desired relative humidity and dry bulb temperature is achieved. However, depending on the changing environmental conditions within the work area 11 brought about by such factors as doors opening and closing or outside weather changes, the temperature and humidity increases beyond what is desired. The microprocessor 60 correlates the sensed values generated by the sensors 21, 22, 23, and, in turn, adjusts the operation of the air washer 20 to lower the temperature and humidity. In the illustrated embodiment, the microprocessor 60 simultaneously could open the chilled water valve 41, decrease the water pump 36 cfm flow so as to reduce atomization, and open the outside damper 46 to allow cooler ambient air to flow through the air washer 20. These three adjustments would decrease the humidity and temperature of the air passing through the air washer 20. In a conventional textile manufacturing plant 10, if these adjustments were made, the conventional dry bulb temperature and relative humidity sensors would independently sense the lowered temperature and humidity conditions and no further adjustments would be made to the air washer control. However, most conventional textile manufacturing plants would not sense the change in barometric pressure which occurs when outside air is brought into the work area 11. The influx of outside air mixing with the return air increases the pressure within the work area 11 by as much as 0.5 inches of mercury since some of the air enclosed within the work area 11 could not be expelled in proportion to the incoming amounts of outside and return air flowing from the air washer 20. Also, if the barometric pressure of the air outside the manufacturing plant 10 has increased, and this air is drawn into the plant 10, the pressure therein will also increase. The increased pressure actually lowers the absolute humidity of the air enclosed within the plant 10 to a humidity level lower than desired.

The present invention is adapted to account for these barometric changes since the microprocessor 60 correlates the sensed value of increased barometric pressure with the sensed values of relative humidity and dry bulb temperature. To increase the absolute humidity of the air enclosed within the work area, the microprocessor 60 could open exhaust damper 53 and increase the flow rate of air enclosed within the work area 11 out of the plant 10 which, in turn, could alleviate the higher pressure within the plant 10. Simultaneously, the water pump 36 flow and resulting water atomization could be increased while the open-end damper 71 could be opened slightly to allow hotter air having a greater moisture retaining capacity through the water curtain. Since the microprocessor 60 repeatedly correlates the sensed values of relatively humidity, dry bulb temperature and barometric pressure, repeated adjustments to the operation of the air washer 20 are made so as to condition the air within the work area 11 towards obtaining a prespecified absolution humidity even when substantial pressure changes occur.

It is understood that the aforesaid description of the application of the present invention is representative of the illustrated air washer design. Each textile manufacturing plant has a different air washer system. Also, the layout of the plant, the types of textile processing apparatus contained therein and the individual designs of the air washers dictate what air washer operation adjustments actually will be made. The present invention provides the vehicle to assist in maintaining greater control over the absolute humidity within a work area.

Figures 6, 7:
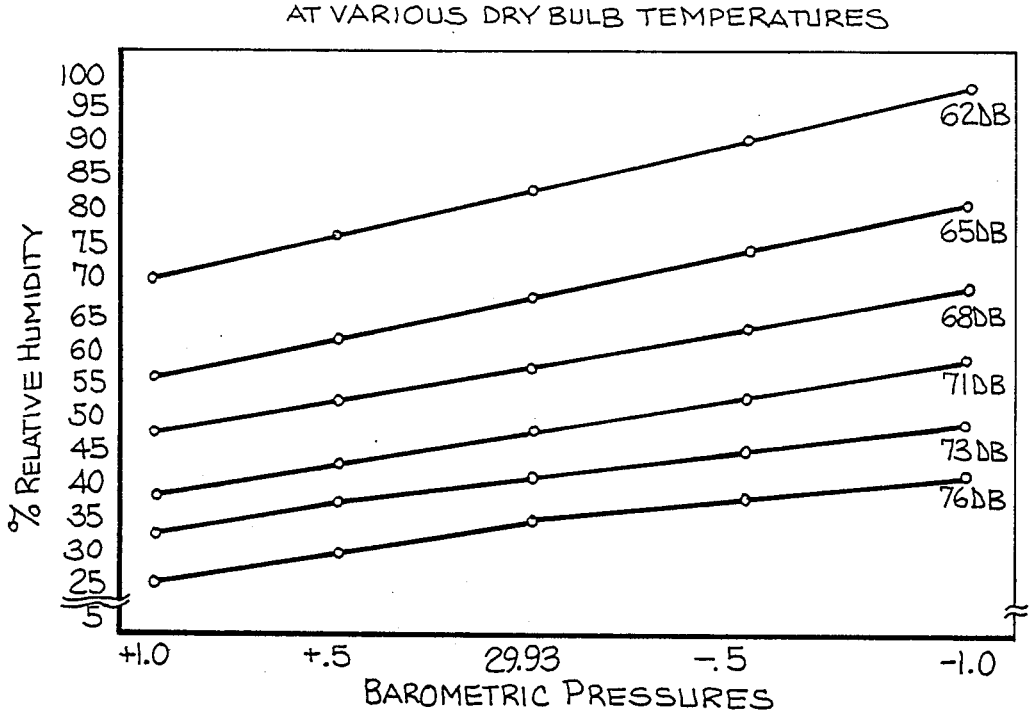
FIG. 6 is a graphical representation of a psychrometric chart showing change in relative humidity at various dry bulb temperatures per change in barometric pressure.
FIG. 7 is a table showing the percentage change in moisture of saturated air at various dry bulb and wet bulb temperatures for a one inch rise in barometric pressure.

Referring now more particularly to FIG. 6, there is shown a graphical representation of a simplified psychrometric chart showing the changes in relative humidity for various dry bulb temperatures where an increase or decrease in barometric pressure occurs from 29.93 inches of mercury. As is well understood in the art of thermodynamics, standard psychrometric charts are based on 29.93 inches of mercury. Most prior art textile air conditioning systems adjust the operation of an air washer by correlating the sensed values of dry bulb temperature and relative humidity with standard psychrometric charts. Pressure changes within a plant usually are not taken into consideration.

The present invention uses the barometric pressure information graphically exhibited in FIG. 6 to correlate sensed values of relative humidity, temperature and barometric pressure so as to effect repeated adjustments to the operation of the air washer and condition the air enclosed with the work area 11 toward obtaining a prespecified absolute humidity. For example, an open-end spinning room 12*a* of a textile manufacturing plant 10 could in one given set of circumstances operate with the least percentage of parted and broken ends at 68 degrees dry bulb and 58 percent relative humidity at 29.93 inches of mercury. If the exhaust heat from the open-end spinning apparatus 70 causes an approximate three degree rise in dry bulb temperature, then based upon a standard psychrometric chart, the actual change in relative humidity is approximately 6 to 8 percent. However, if the barometric pressure within the work area 11 also has increased, such as when an influx of outside air is drawn through the air washer 20, the actual grains of moisture per pound of dry air, i.e. the absolute humidity, is decreased. Referring to FIG. 6, the actual corrected relative humidity is 36%. Thus, air washer operation adjustments actually are made as if the air measured 36% relatively humidity at the standard barometric pressure of 29.93 inches of mercury. FIG. 7 is a table exhibiting the percentage change in total grains of moisture of saturated air for a one inch rise in barometric pressure from standard barometric pressure of 29.93 inches of mercury. As evident in the tabulated information, under a given set of circumstances, the pressures within a textile manufacturing plant 10 can adversely affect the moisture level of the air enclosed within the plant 10.

The foregoing embodiments are to be considered illustrative rather than restrictive of the invention and those modifications which come within the range of equivalents of the claims to be included therein.

That which is claimed is:

1. In combination with a substantially enclosed and pressurized work area, a system for controlling the environment within said area toward obtaining a prespecified absolute humidity, said system comprising a plurality of condition sensing signal generating means positioned within said work area with said signal generating means being responsive to sensed environmental conditions, said signal generating means including first signal generating means responsive to sensed relative humidity, second signal generating means responsive to sensed dry bulb temperature, and third signal generating means responsive to sensed barometric pressure, said system further including an air washer operatively communicating with said work area for conditioning the air enclosed within said work area and microprocessing means operatively connected to said air washer and said plurality of condition sensing signal generating means for receiving the generated signals and for correlating the received sensed values and to repeatedly adjust the operation of the air washer so as to condition the air within said work area toward obtaining said prespecified absolute humidity.

2. The system as claimed in claim 1 wherein said microprocessing means operatively connected to said air washer comprises signal generating means for transmitting signals to said air washer for effecting repeated adjustments to the air washer.

3. The system as claimed in claim 1 wherein said air washer includes damper means for receiving and varying one or more of the following: (1) the amount of return air flowing from said work area through said air washer and back into the work area, (2) the amount of ambient air drawn in from outside said work area through said air washer and into the work area, and (3) the amount of bypass air flowing from said work area into an area outside said work area and back into the work area.

4. The system as claimed in claim 3 wherein said damper means includes means responsive to air washer operation adjustments determined by said microprocessing means so as to vary the amount of return and ambient air flowing through said air washer, and the amount of bypass air flowing back into the work area.

5. The system as claimed in claim 1 wherein said air washer includes means for controlling the temperature of water supplied to said air washer in response to air washer operation adjustments determined by said microprocessing means.

6. The system as claimed in claim 5 wherein said water temperature control means includes chilled water supply means for supplying chilled water to said air washer.

7. The system as claimed in claim 5 wherein said water temperature control means includes means for heating water used in said air washer.

8. The system as claimed in claim 1 including a plurality of each of said first, second and third condition sensing signal generating means positioned within said work area.

9. The system as claimed in claim 1 wherein said air washer includes means for controlling the amount of air passing through said air washer in response to air washer operation adjustments determined by said microprocessing means.

10. The system as claimed in claim 1 wherein said air washer includes water atomization control means for controlling water atomization in response to air washer operation adjustments determined by said microprocessing means.

11. The system as claimed in claim 1 wherein said work area comprises a plurality of defined work zones and wherein each defined work zone includes each of said first, second and third condition sensing signal generating means.

12. In combination with a textile plant having a substantially enclosed and pressurized work area containing a plurality of textile processing apparatus such as a spinning frame wherein yarn is being formed from textile fibrous material, a system for controlling the environment within said area toward obtaining a prespecified absolute humidity for enhanced operation of and production from the textile processing apparatus so as to reduce the number of parted or broken ends, said system comprising a plurality of condition sensing signal generating means positioned within said work area with said signal generating means being responsive to sensed environmental conditions, said signal generating means including first signal generating means responsive to sensed relative humidity, second signal generating means responsive to sensed dry bulb temperature, and third signal generating means responsive to sensed barometric pressure, said system further including an air washer operatively communicating with said work area for conditioning the air enclosed within said work area and microprocessing means operatively connected to said air washer and said plurality of condition sensing signal generating means for receiving the generated signals and for correlating the received sensed values and to repeatedly adjust the operation of the air washer so as to condition the air within said work area toward obtaining said prespecified absolute humidity.

13. The system as claimed in claim 12 wherein said microprocessing means operatively connected to said air washer comprises signal generating means for transmitting signals to said air washer for effecting repeated adjustments to the air washer.

14. The system as claimed in claim 12 wherein said air washer includes damper means for receiving and varying one or more of the following: (1) the amount of return air flowing from said work area through said air washer and back into the work area, (2) the amount of ambient air drawn in from outside said work area through said air washer and into the work area, and (3) the amount of bypass air flowing from said work area into an area outside said work area and back into the work area.

15. The system as claimed in claim 14 wherein said damper means includes means responsive to air washer operation adjustments determined by said microprocessing means so as to vary the amount of return and ambient air flowing through said air washer, and the amount of bypass air flowing back into said work area.

16. The system as claimed in claim 15 wherein said work area includes open-end spinning apparatus having exhaust means for discharging hot exhaust air from said apparatus during a spinning operation and including means associated with said open-end spinning apparatus for withdrawing hot exhaust air away from said open-end spinning apparatus, and wherein said exhaust means operatively connects said damper means so as to vary the amount of exhaust air flowing from off said open-end spinning apparatus through the air washer and back into the work area in response to the air washer operation adjustments determined by said microprocessing means.

17. The system as claimed in claim 12 wherein said air washer includes means for controlling the temperature of water supplied to said air washer in response to air washer operation adjustments determined by said microprocessing means.

18. The system as claimed in claim 17 wherein said water temperature control means includes chilled water supply means for supplying chilled water to said air washer.

19. The system as claimed in claim 17 wherein said water temperature control means includes means for heating water used in said air washer.

20. The system as claimed in claim 12 including a plurality of each of said first, second and third condition sensing signal generating means positioned within said work area.

21. The system as claimed in claim 12 wherein said air washer includes means for controlling the amount of air passing through said air washer in response to air washer operation adjustments determined by said microprocessing means.

22. The system as claimed in claim 12 wherein said air washer includes water atomization control means for controlling water atomization in response to air washer operation adjustments determined by said microprocessing means.

23. The system as claimed in claim 12 wherein said work area comprises a plurality of defined work zones and wherein each defined work zone includes each of said first, second and third condition sensing signal generating means.

24. In combination with a textile plant having a substantially enclosed and pressurized work area divided into a plurality of work zones separated from each other by walls or other means internal to said work area and wherein at least one of the work zones contains a plurality of textile processing apparatus such as a spinning frame wherein yarn is being formed from textile fibrous material, a system for controlling the environment within said work area toward obtaining a prespecified absolute humidity for the enhanced operation of and production from the textile processing apparatus so as to reduce the number of parted and broken ends, said system comprising a plurality of condition sensing signal generating means positioned within each work zone with said signal generating means being responsive to sensed environmental conditions, said signal generating means including first signal generating means responsive to sensed relative humidity, second signal generating means responsive to sensed dry bulb temperature, and third signal generating means responsive to sensed barometric pressure, and wherein each work zone includes each of said first, second and third condition sensing signal generating means, said system further including a plurality of air washers operatively communicating with said work zones for conditioning the air enclosed within said work area and wherein each work zone has at least one air washer operatively communicating therewith, and microprocessing means operatively connected to said air washers and said plurality of signal generating means for receiving the signals therefrom and for correlating the received sensed values and to repeatedly adjust the operation of the air washers so as to condition the air within said work area toward obtaining said prespecified absolute humidity.

25. The system as claimed in claim 24 wherein said microprocessing means operatively connected to said air washers comprises signal generating means for transmitting signals to said air washers for effecting repeated adjustments to the air washers.

26. The system as claimed in claim 24 wherein each of said air washers includes damper means for receiving and varying one or more of the following: (1) the amount of return air flowing from said work area through said air washers and back into the work area, (2) the amount of ambient air drawn in from outside said work area through said air washers and into the work area, and (3) the amount of bypass air flowing from said work area into an area outside said work area and back into the work area.

27. The system as claimed in claim 26 wherein said damper means includes means responsive to air washer operation adjustments determined by said microprocessing means so as to vary the amount of return and ambient air flowing through each of said air washers, and the amount of bypass air flowing back into the work area.

28. The system as claimed in claim 27 wherein at least one of said work zones includes open-end spinning apparatus having exhaust means for discharging hot exhaust air from said apparatus during a spinning operation and including means associated with said open-end spinning apparatus for withdrawing hot exhaust air away from the open-end spinning apparatus, and wherein said exhaust means operatively connects said damper means so as to vary the amount of exhaust air flowing from said open-end spinning apparatus through the air washer and back into the air washer in response to the air washer operation adjustments determined by said microprocessing means.

29. The system as claimed in claim 24 wherein each of said air washers includes means for controlling the temperature of water supplied to each of said air washers in response to air washer operation adjustments determined by said microprocessing means.

30. The system as claimed in claim 29 wherein said water temperature control means includes chilled water supply means for supplying chilled water to said air washers.

31. The system as claimed in claim 29 wherein said water temperature control means includes means for heating water used in said air washers.

32. The system as claimed in claim 24 wherein each of said air washers includes means for controlling the amount of air passing through said air washers in response to air washer operation adjustments determined by said microprocessing means.

33. The system as claimed in claim 24 wherein each of said air washers includes water atomization control means for controlling water atomization in response to air washer operation adjustments determined by said microprocessing means.

34. A method of controlling the environment within a substantially enclosed and pressurized work area comprising the steps of repeatedly sensing the environmental conditions within the work area, including sensing the relative humidity, dry bulb temperature and barometric pressure, conditioning the air enclosed within the work area toward obtaining a prespecified absolute humidity by directing a flow of air through an air washer into the work area, feeding the sensed values to a microprocessor, correlating within the microprocessor the sensed values of relative humidity, dry bulb temperature and barometric pressure fed thereto to determine what air washer operation adjustments are necessary to condition the air enclosed within the work area toward obtaining said prespecified absolute humidity, and in response to air washer operation adjustments determined by the microprocessor effecting repeated adjustments of the air washer so as to maintain the condition of the air within the work area at said prespecified absolute humidity.

35. The method as claimed in claim 34 wherein the step of conditioning the air includes one or more of the steps of (1) drawing an amount of return air from the work area through the air washer and back into the work area, (2) drawing an amount of ambient air from outside the work area through the air washer and into the work area, (3) drawing an amount of bypass air from the work area, to an area outside the work area and then back into the work area, and controlling the respective amounts drawn in response to the air washer operation adjustments determined by the microprocessor.

36. The method as claimed in claim 34 including the step of controlling the temperature of water supplied to the air washer in response to air washer operation adjustments determined by the microprocessor.

37. The method as claimed in claim 34 including the step of controlling the amount of air passing through the air washer in response to air washer operation adjustments determined by the microprocessor.

38. The method as claimed in claim 34 including the step of sensing the environmental conditions, including sensing the relative humidity, dry bulb temperature and barometric pressure within a plurality of work zones defined within the work area.

39. The method as claimed in claim 34 including the step of controlling the atomization of water used in the air washer in response to the air washer operation adjustments determined by the microprocessor.

40. A method of controlling the environment within a textile plant having a substantially enclosed and pressurized work area containing a plurality of textile processing apparatus such as a spinning frame wherein yarn is being formed from textile fibrous material comprising the steps of repeatedly sensing the environmental conditions within the area, including sensing the relative humidity, dry bulb temperature and barometric pressure, conditioning the air enclosed within the work area toward obtaining a prespecified absolute humidity by directing a flow of air through an air washer into the work area, feeding the sensed values to a microprocessor, correlating within the microprocessor the sensed values of relative humidity, temperature and barometric pressure fed thereto to determine what air washer operation adjustments are necessary to condition the air enclosed within the work area to said prespecified absolute humidity, and in response to air washer operation adjustments determined by the microprocessor effecting repeated adjustments of the air washer so as to maintain the condition of the air within the work area at said prespecified absolute humidity and enhance the operation of and production from the textile processing apparatus so as to reduce the number of parted or broken ends.

41. The method as claimed in claim 40 wherein the step of conditioning the air includes one or more of the steps of (1) drawing an amount of return air from the work area through the air washer and back into the work area, (2) drawing an amount of ambient air from outside the work area through the air washer and into the work area, (3) drawing an amount of bypass air from the work area to an area outside the work area and then back into the work area, and controlling the amounts drawn in response to the air washer operation adjustments determined by the microprocessor.

42. The method as claimed in claim 40 wherein the work area includes open-end spinning apparatus and wherein the step of conditioning the air includes the step of drawing the hot exhaust air from off the open-end spinning apparatus to an area outside the work area, recycling a portion of the drawn air through the air washer and back into the work area and regulating the amount recycled in response to the air washer operation adjustments determined by the microprocessor.

43. The method as claimed in claim 40 including the step of controlling the temperature of water supplied to the air washer in response to air washer operation adjustments determined by the microprocessor.

44. The method as claimed in claim 40 including the step of controlling the amount of air passing through the air washer in response to air washer operation adjustments determined by the microprocessor.

45. The method as claimed in claim 40 including the step of controlling the atomization of water used in the air washer in response to the air washer operation adjustments determined by the microprocessor.

46. The method as claimed in claim 40 including the step of sensing environmental conditions within a plurality of work zones defined within the work area.

47. A method of controlling the environment within a textile plant having a substantially enclosed and pressurized work area divided into a plurality of work zones separated from each other by walls or other means internal to the work area and wherein at least one of the work zones contains a plurality of textile processing apparatus such as a spinning frame wherein yarn is being formed from fibrous material comprising the steps of repeatedly sensing the environmental conditions within each work zone, including sensing the relative humidity, dry bulb temperature and barometric pressure, conditioning the air enclosed within the work area toward obtaining a prespecified absolute humidity by directing flows of air through a plurality of air washers into each work zone, feeding the sensed values to a microprocessor, correlating within the microprocessor the sensed values of relative humidity, temperature and barometric pressure fed thereto to determine what air washer operation adjustments are necessary to condition the air enclosed within the work area toward obtaining said prespecified absolute humidity, and in response to air washer operation adjustments determined by the microprocessor effecting repeated adjustments of the air washers to condition the air within the work area at said prespecified absolute humidity, and enhance the operation of and production from the textile processing apparatus so as to reduce the number of parted or broken ends.

48. The method as claimed in claim 47 wherein the step of conditioning the air includes one or more of the steps of (1) drawing an amount of air from the work area through the air washers and back into the work area, (2) drawing an amount of ambient air from outside the work area through the air washers and into the work area, (3) drawing an amount of bypass air from the work area to an area outside the work area and then back into the work area, and controlling the amounts drawn in response to the air washer operation adjustments determined by the microprocessor.

49. The method as claimed in claim 47 wherein the work zone having the plurality of textile processing equipment includes open-end spinning apparatus, and wherein the step of conditioning the air includes the step of drawing the hot exhaust air from off the open-end spinning machinery to an area outside the work area, recycling a portion of the drawn air through the air washer and back into the work area and regulating the amount recycled in response to the air washer operation adjustments determined by the microprocessor.

50. The method as claimed in claim 47 including the step of controlling the temperature of water supplied to the air washers in response to air washer operation adjustments determined by the microprocessor.

51. The method as claimed in claim 47 including the step of controlling the amount of air passing through the air washers in response to air washer operation adjustments determined by the microprocessor.

52. The method as claimed in claim 47 including the step of controlling the atomization of water used in the air washer in response to the air washer operation adjustments determined by the microprocessor.

* * * * *